US006666505B2

(12) United States Patent
Greger et al.

(10) Patent No.: US 6,666,505 B2
(45) Date of Patent: Dec. 23, 2003

(54) RECLINING CHILD SEAT

(75) Inventors: Jeff G. Greger, Lititz, PA (US); Baku Kakuda, Reading, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/127,686

(22) Filed: Apr. 23, 2002

(65) Prior Publication Data

US 2003/0197408 A1 Oct. 23, 2003

(51) Int. Cl.[7] ..... A47B 83/02; A47D 1/00

(52) U.S. Cl. ..... 297/148; 297/354.12; 297/374; 297/376; 297/377; 297/256.1; 297/256.13; 297/153

(58) Field of Search ..... 297/148, 149, 297/153, 354.12, 374, 376, 377, 256.1, 256.13, 250.1

(56) References Cited

U.S. PATENT DOCUMENTS

| | | | | | |
|---|---|---|---|---|---|
| 533,727 | A | * | 2/1895 | McCaffrey | 297/377 X |
| 1,896,455 | A | * | 2/1933 | McCulloh | 297/377 X |
| 1,945,781 | A | | 2/1934 | Kersten | |
| 2,520,377 | A | | 8/1950 | Schrougham | |
| 2,691,411 | A | | 10/1954 | Thatcher | |
| 2,790,484 | A | | 4/1957 | Pollack | |
| 3,649,074 | A | | 3/1972 | McDonald et al. | 297/377 |
| 3,883,136 | A | | 5/1975 | Kim | |
| 3,918,822 | A | * | 11/1975 | Rauschenberger | 297/354.12 X |
| 3,975,050 | A | | 8/1976 | McKee | 297/328 |
| 4,231,612 | A | | 11/1980 | Meeker | 297/256.13 |
| 4,240,625 | A | | 12/1980 | Meeker | 297/329 X |
| 4,324,432 | A | | 4/1982 | Eldon, III et al. | 297/377 |
| 4,325,578 | A | | 4/1982 | Borucki | |
| 4,386,805 | A | * | 6/1983 | Boisset | 297/354.12 X |
| 4,456,302 | A | | 6/1984 | Knoedler et al. | 297/150 X |
| 4,487,453 | A | * | 12/1984 | Emmerich et al. | 297/377 X |
| 4,522,446 | A | * | 6/1985 | Sheridan | 297/377 |
| 4,580,833 | A | | 4/1986 | Waples | |
| 4,603,902 | A | | 8/1986 | Maloney | |
| 4,697,845 | A | | 10/1987 | Kamman | 297/377 X |
| 4,768,825 | A | | 9/1988 | Quinlan, Jr. | |
| 4,818,016 | A | | 4/1989 | Mariol et al. | 297/174 CS |

(List continued on next page.)

FOREIGN PATENT DOCUMENTS

GB 2 358 793 A 8/2001

OTHER PUBLICATIONS

Photographs of Fisher–Price High Chair, 4 pp. (available pre–Arp. 2002).
Brochure, "Fisher–Price Health Care™ High Chair", pp 1–16 (Mattel, Inc. 2001).
Photographs of Fisher–Price High Chair, 3 pp.

*Primary Examiner*—Rodney B. White
(74) *Attorney, Agent, or Firm*—Foley & Lardner

(57) ABSTRACT

A chair is provided that includes a seat member, a back rest pivotally connected to the seat member, and first and second recline mechanisms. The seat member includes a first back rest support portion and a second back rest support portion. The back rest support portions each have a tooth-receiving member at an upper exterior surface. The recline mechanisms each include a lever mounted to the back rest. The lever of each recline mechanism has a tooth for receipt in a respective tooth-receiving member, and the lever is movable between an engaged state and a disengaged state. When the lever is in the engaged state, the tooth engages the tooth-receiving member to prevent rearward pivotal motion of the back rest relative to the seat member. When the lever is in the disengaged state, the tooth is disengaged from the tooth-receiving member. When the levers of the recline mechanisms are both in the disengaged state, the back rest is allowed to pivot relative to the seat member.

28 Claims, 17 Drawing Sheets

U.S. PATENT DOCUMENTS

| | | | | |
|---|---|---|---|---|
| 4,938,603 | A | 7/1990 | Turner et al. | |
| 5,131,719 | A | 7/1992 | Kassai | 297/151 X |
| 5,195,770 | A | 3/1993 | Ishikura | |
| 5,249,838 | A | 10/1993 | Kulpa et al. | 297/328 |
| 5,277,472 | A | 1/1994 | Freese et al. | 297/329 X |
| 5,364,137 | A | 11/1994 | Shimer | 297/327 |
| 5,507,550 | A | 4/1996 | Maloney | 297/327 X |
| 5,527,096 | A | 6/1996 | Shimer | 297/327 |
| 5,562,548 | A | 10/1996 | Pinch et al. | 297/256.16 X |
| 5,593,207 | A | 1/1997 | Turner | 297/369 X |
| 5,685,605 | A | 11/1997 | Kassai et al. | |
| 5,803,817 | A | 9/1998 | Stern | |
| 5,820,207 | A | 10/1998 | Wang | 297/148 X |
| 5,951,102 | A | 9/1999 | Poulson et al. | 297/327 X |
| 5,975,631 | A | 11/1999 | Fair et al. | 297/354.12 X |
| 5,984,791 | A | 11/1999 | Fair et al. | 297/155 X |
| 6,022,277 | A | 2/2000 | Jankowski | |
| 6,027,409 | A | 2/2000 | Favorito et al. | |
| 6,082,814 | A | 7/2000 | Celestina-Krevh et al. | 297/153 |
| 6,089,666 | A | 7/2000 | Rosko | 297/118 X |
| 6,126,236 | A | 10/2000 | Wu | 297/325 |
| 6,161,898 | A | 12/2000 | Brevi | 297/328 |
| 6,293,623 | B1 | 9/2001 | Kain et al. | 297/153 X |
| 6,334,647 | B1 | 1/2002 | Khorasi | 297/148 |
| 6,334,652 | B1 | 1/2002 | Chen et al. | 297/256.13 X |
| 6,347,830 | B1 | 2/2002 | Chen | |
| 6,347,833 | B1 | 2/2002 | Chen | 297/328 |
| 2001/0013688 | A1 | 8/2001 | Warner, Jr. et al. | |
| 2001/0028184 | A1 | 10/2001 | Sitarski et al. | 297/118 |

* cited by examiner

RECLINING CHILD SEAT

BACKGROUND

The present invention relates to child seats and, in particular, to a reclining child seat.

Parents and care givers for infants and children routinely use seats or chairs in the care of children. For example, a care giver may place a child in a high chair to assist in feeding the child. The care giver may also use a mechanized child swing to sooth or entertain a child.

Infants and small children often pass from wakefulness to sleep in just a few minutes. Many parents are familiar with the experience of having a child fall asleep in a high chair while eating a meal. Mechanized swings are also used help a child go to sleep. However, when a child falls asleep in a high chair or a swing, the child is usually in an upright position. This body position often prevents the child from resting well. Thus, a child care giver must lay the child down for the duration of the child's sleep. However, removing the child from the seat may cause unwanted disruption to the child's slumber. Therefore, it would be advantageous to have an improved child seat that may be easily reclined to allow the child to recline and sleep without disruption.

While reclining seats are known in the art, there exists a need for a reclining child seat that can be operated easily. There further exists a need for a child seat with a back rest that may be adjusted simply and locked into position securely. A need also exists for a reclining child seat which allows the child care giver to choose the desired adjustment angle of a seat back relative to a seat surface by seeing potential engagement positions.

SUMMARY OF THE INVENTION

According to the present invention, a chair comprising a seat member, a back rest, and first and second recline mechanisms is provided. The chair may form part of a child swing or a child high chair, for example. The seat member includes first and second back rest support portions, each having a tooth-receiving member at an upper exterior surface thereof. The back rest is pivotally connected to the seat member. The recline mechanisms each include a lever mounted to the back rest. The lever has a tooth for receipt in the tooth-receiving member, and the lever is movable between an engaged state and a disengaged state. When the lever is in the engaged state, the tooth engages the tooth-receiving member to prevent rearward pivotal motion of the back rest relative to the seat member. When the lever is in the disengaged state, the tooth is disengaged from the tooth-receiving member. When the levers of the first and second recline mechanisms both are in the disengaged state, the back rest is allowed to pivot relative to the seat member.

The tooth-receiving member of each back rest support portion may comprise a slot formed at the upper exterior surface of the back rest support portion. The tooth-receiving member may be a first tooth-receiving member, and each back rest support portion may further comprise a second tooth-receiving member. In such an arrangement, the levers may position the back rest at a first angle relative to the seat member when the teeth of the levers engage the first tooth-receiving members, and the levers may position the back rest at a second angle relative to the seat member when the teeth of the levers engage the second tooth-receiving members. The tooth-receiving members may be formed at the upper surface of each back rest support portion at locations to correspond to different recline angles of the back rest relative to the seat member.

The back rest further may comprise a side fender with a window disposed therein, and the lever may comprise a grip extending through the window. In addition, the lever may be biased to the engaged state by a spring element, such as a spring or a spring arm.

The lever may comprise an upper portion having guide nub, a lower portion having a pivot member, and a spring retention post, and the back rest may comprise a first rib having a guide reception slot, a second rib having a pivot reception slot, and a spring bearing area. In another embodiment, the lever may comprise an upper portion having guide nub and a lower portion having a pivot member, and the back rest may comprise a guide nub bearing area, a spring arm bearing area, and a pivot axle.

According to another aspect of the invention, a chair is provided that comprises a seat member having first and second sides, a back rest pivotally connected to the seat member, and first and second recline mechanisms. Each side of the seat member has a tooth-receiving member. The recline mechanisms each include a lever mounted to the back rest. The lever has a barbed tooth, and the lever is movable between an engaged state and a disengaged state. When the lever is in the engaged state, the barbed tooth engages the tooth-receiving member to prevent rearward pivotal motion of the back rest relative to the seat member, and, when the lever is in the disengaged state, the barbed tooth is disengaged from the tooth-receiving member. When the levers of the recline mechanisms are both in the disengaged state, the back rest is allowed to pivot relative to the seat member.

According to yet another aspect of the invention, a chair is provided that comprises a seat member having first and second sides, a back rest pivotally connected to the seat member, and first and second recline mechanisms. Each side of the seat member has a first set of tooth-receiving members. The recline mechanism each include a lever mounted to the back rest. The lever has a set of teeth, and the lever is movable between an engaged state and a disengaged state. When the lever is in the engaged state, the set of teeth engages the set of tooth-receiving members to prevent rearward pivotal motion of the back rest relative to the seat member. When the lever is in the disengaged state, the set of teeth is disengaged from the set of tooth-receiving members. When the levers of the recline mechanisms are both in the disengaged states, the back rest is allowed to pivot relative to the seat member. The chair may include first and second sets of tooth-receiving members. The first set of tooth-receiving members may comprise a first pair of adjacent slots formed in the seat member, and the second set of tooth-receiving members may comprise a second pair of adjacent slots formed in the seat member spaced from the first pair of adjacent slots. The set of teeth may comprise a pair of teeth arranged to selectively engage the first and second pairs of adjacent slots.

According to still another aspect of the invention, a method for changing a position of a back rest of a chair relative to a seat member of the chair is provided. The method comprises providing the chair with a back rest support portion. The back rest support portion has a plurality of tooth-receiving slots on an upper exterior surface thereof. The method also comprises mounting a lever to the back rest, the lever having a tooth for receipt in the tooth-receiving slots. The method further comprises engaging the tooth in a first one of the tooth-receiving slots to position the back rest at a first angle relative to the seat member; disengaging the tooth of the lever from the first one of the tooth-receiving slots; pivoting the back rest relative to the seat member; and engaging the tooth in a second one of the tooth-receiving slots to position the back rest at a second angle relative to the seat member. The disengaging step may include deforming a spring that biases the lever into an engaged state.

According to a further aspect of the invention, a chair is provided that comprises a seat member, a back rest pivotally connected to the seat member, and a recline mechanism. The back rest support portion has a tooth-receiving member. The recline mechanism includes a lever mounted to the back rest, and the lever has a tooth for receipt in the tooth-receiving member. The lever is movable between an engaged state, in which the tooth is received in the tooth-receiving member, and a disengaged state, in which the tooth is disengaged from the tooth-receiving member. When the lever is in the engaged state, inclining the back rest causes the lever to assume the disengaged state.

Various preferred embodiments of the invention will now be set forth in more detail. These embodiments are provided by way of example only, and should not be construed as limiting. Other embodiments as would occur to those skilled in the art are also within the spirit and scope of this invention.

BRIEF DESCRIPTION OF THE DRAWINGS

These and other features, aspects and advantages of the present invention will become apparent from the following description, appended claims, and the accompanying exemplary embodiments shown in the drawings, which are briefly described below.

DETAILED DESCRIPTION

The present invention provides a reclining child seat that includes a back rest pivotally connected to a seat member so that the back rest can be selectively pivoted to various recline angles relative to the seat member. In use, a child may sit on the seat surface, and the back of the child may be supported by the back rest. As the angle of the back rest is adjusted by a parent or child care giver, the child seat will support the body of the child in various body positions. For example, when the back rest is fully reclined, the body of the child will be supported in a more restful horizontal position. In contrast, when the back rest is fully inclined, the body of the child is supported in an upright, sitting position.

Figure 1:
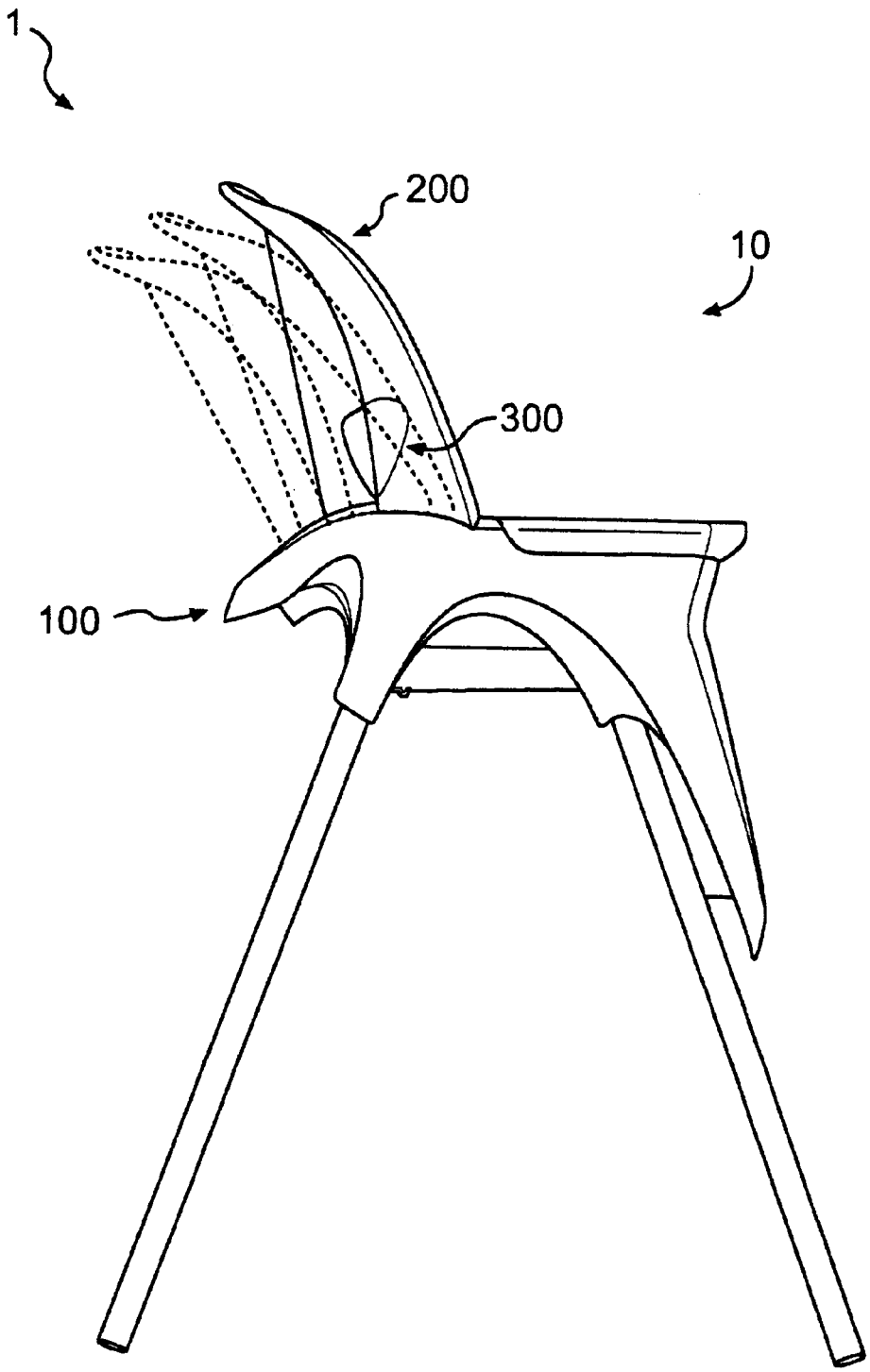
FIG. 1 is a side view of a reclining child seat shown as part of a high chair structure in accordance with the present invention, with exemplary back rest recline positions shown in phantom.

FIGS. 1–7 illustrate a reclining child seat in accordance with the invention. The reclining child seat 10 forms part of a child high chair 1 in this embodiment, as shown in FIG. 1. The reclining child seat 10 may comprise a seat member 100, an adjustable back rest 200, and recline mechanisms 300 on either side of the seat 10. These components of the reclining child seat may be constructed of plastic that has been injection-molded, blow molded, or formed by other conventional molding techniques. The recline mechanisms 300 may be used to adjust the angle of back rest 200 to a plurality of angles with respect to the surface of seat member 100, as shown in phantom. Here, three levels of recline are shown; however, it will be understood that the child seat can be formed to adjust to a different number of recline angles.

Figure 2:
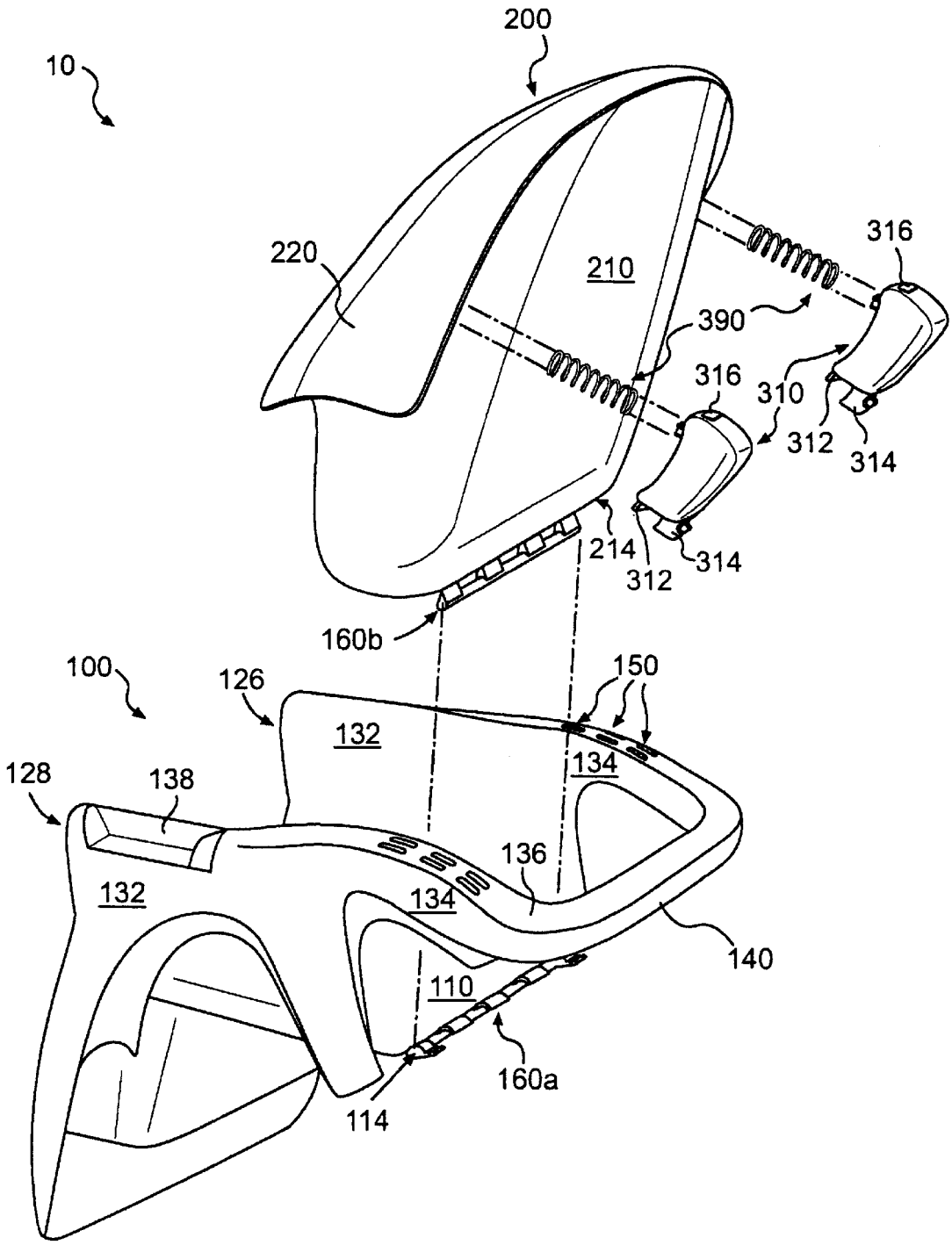
FIG. 2 is an exploded view of the reclining child seat of FIG. 1.

An exploded rear perspective view of the reclining child seat 10 is shown in FIG. 2. The adjustable back rest 200 may be pivotally connected or mounted to seat 100. The seat member 100 can include generally planar seat section 110 upon which a child can sit. Back rest 200 can include a generally planar back rest section 210. The plane of the back rest section 210 can intersect an axis defined by or parallel to the rear boundary 114 of the seat section 110. In this regard, the back rest 200 may be connected to the seat member 100 via hinge members 160*a*, 160*b* disposed along the rear boundary 114 of the seat section 110 and the lower boundary 214 of the back rest section 210, respectively. This hinge 160*a*, 160*b* allows the back rest 200 to pivot relative to the seat member 100 to thereby adjust the angle between the back rest section 210 and the seat section 110. In other embodiments of the invention, the back rest 200 may be connected to the seat member 100 by a pivot point on either side of the back rest or by a pivot axle disposed parallel to the rear boundary of the seat surface. Other pivot means known to those skilled in the art are also within the scope of the invention.

The seat member 100 can include left and right seat sides 126 and 128, each having an arm support portion 132 and a back rest support portion 134. Arm support portion 132 is disposed toward the front of seat member 100, while back rest support portion 134 is disposed toward the rear of seat member 100, as shown in FIG. 2. When the back rest 200 is connected to the seat member 100, and the back rest is in an upright position, the arm support portions 132 generally are in front of the back rest 200. The back rest support portions 134 generally define that part of the seat member 200 that the back rest 200 contacts through its range of motion. In the embodiment shown in FIG. 2, the upper surface or edge 136 of the seat member 100 between the arm support portions 132 and the back rest support portions 134 is contiguous, the seat member 100 being a unitary molded piece. In other embodiments, the top surface 136 between the arm support portions and the back rest support portions need not be contiguous.

In one embodiment of the invention, the arm support portions 132 include fixtures 138 adapted to receive a child tray (not shown). This child tray can be used to support foodstuff or toys for the child. When the child tray is not present, the arm support portions 132 may be used by the occupant of the child seat as arm rests.

The back rest support portions 134 of the left and right seat sides 126 and 128 guide the motion of, and support the load borne by, the back rest 200. The back rest support portions 134 may be connected to each other by a rear support 140. The rear support 140 may serve as a brace or strut to prevent flexion or deformation of the child seat as the seat section 110 receives a load. The lateral stability of the rear support 140 also may prevent left and right sides 126 and 128 from collapsing inward toward the center of seat surface 110 as the load of the child bears downward on seat surface 110. This rear support 140 also can support the back rest 200 when the back rest 200 is positioned in a fully reclined position.

The upper exterior surface 136 of each back rest support portion 134 may include spaced tooth-receiving members, or tooth-receiving openings, 150, such as slots, apertures, depressions, holes, or notches. Openings 150 are adapted to receive engagement teeth 314 of an engagement lever 310, as will be described below.

The child seat 10 of the present invention is provided with recline mechanisms 300, shown generally in FIG. 1. The recline mechanisms 300 inhibit or enable the motion of back rest 200 relative to seat member 100. The recline mechanisms 300 may also control the angle at which back rest 200 may be fixed relative to seat surface 110.

Figure 3:
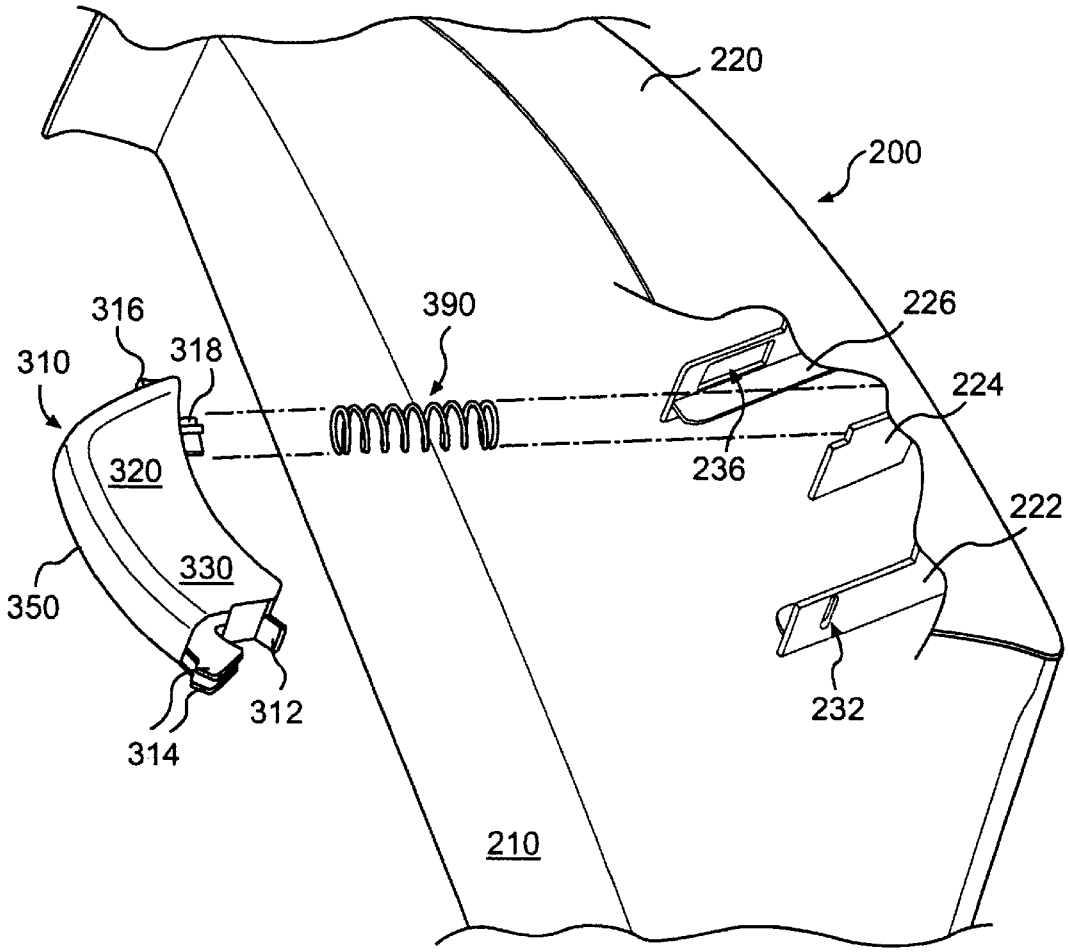
FIG. 3 is an exploded view of a portion of the recline mechanism of the reclining child seat of FIG. 1.
Figure 4:
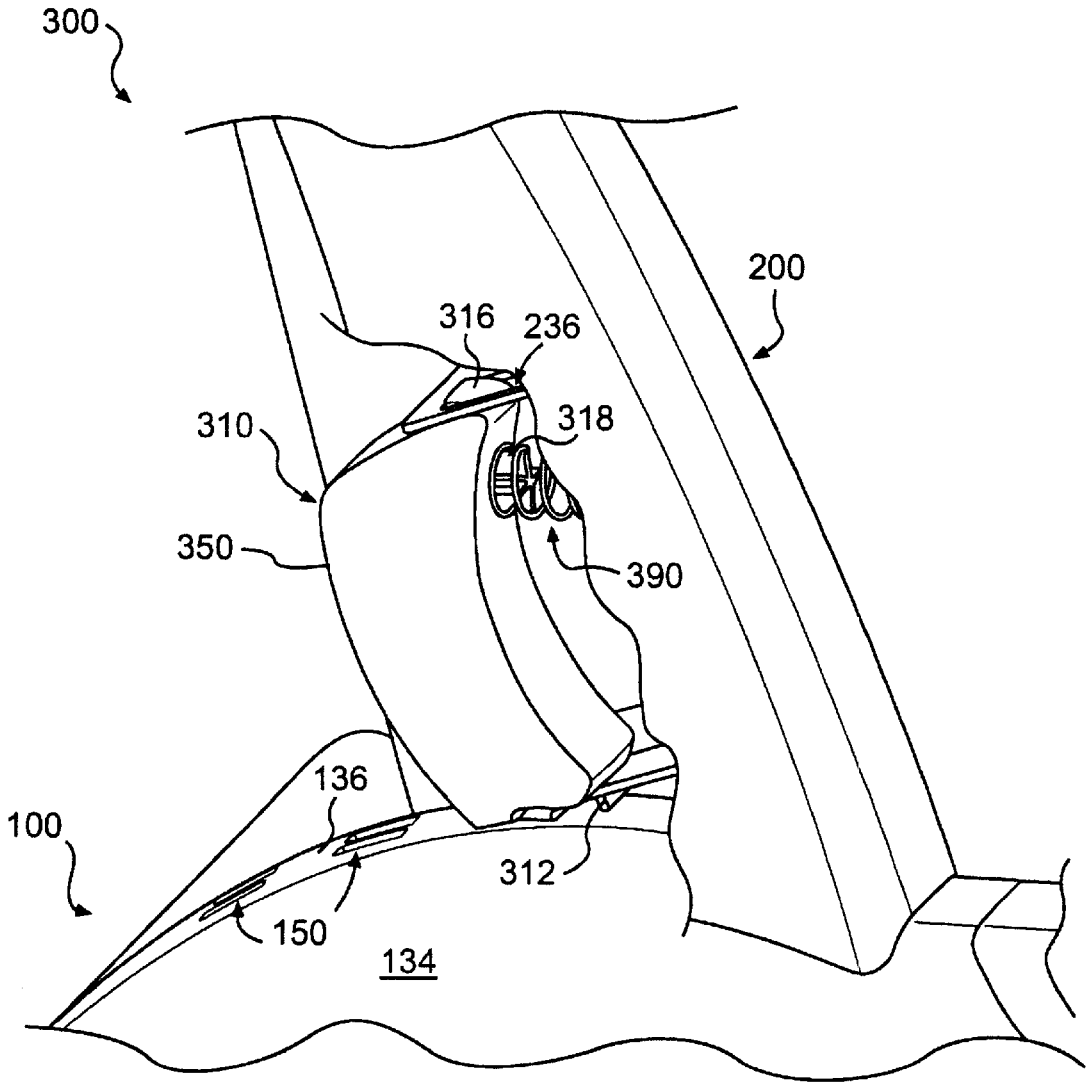
FIG. 4 is an enlarged, detail view of the recline mechanism of the reclining child seat of FIG. 1.
Figure 5:
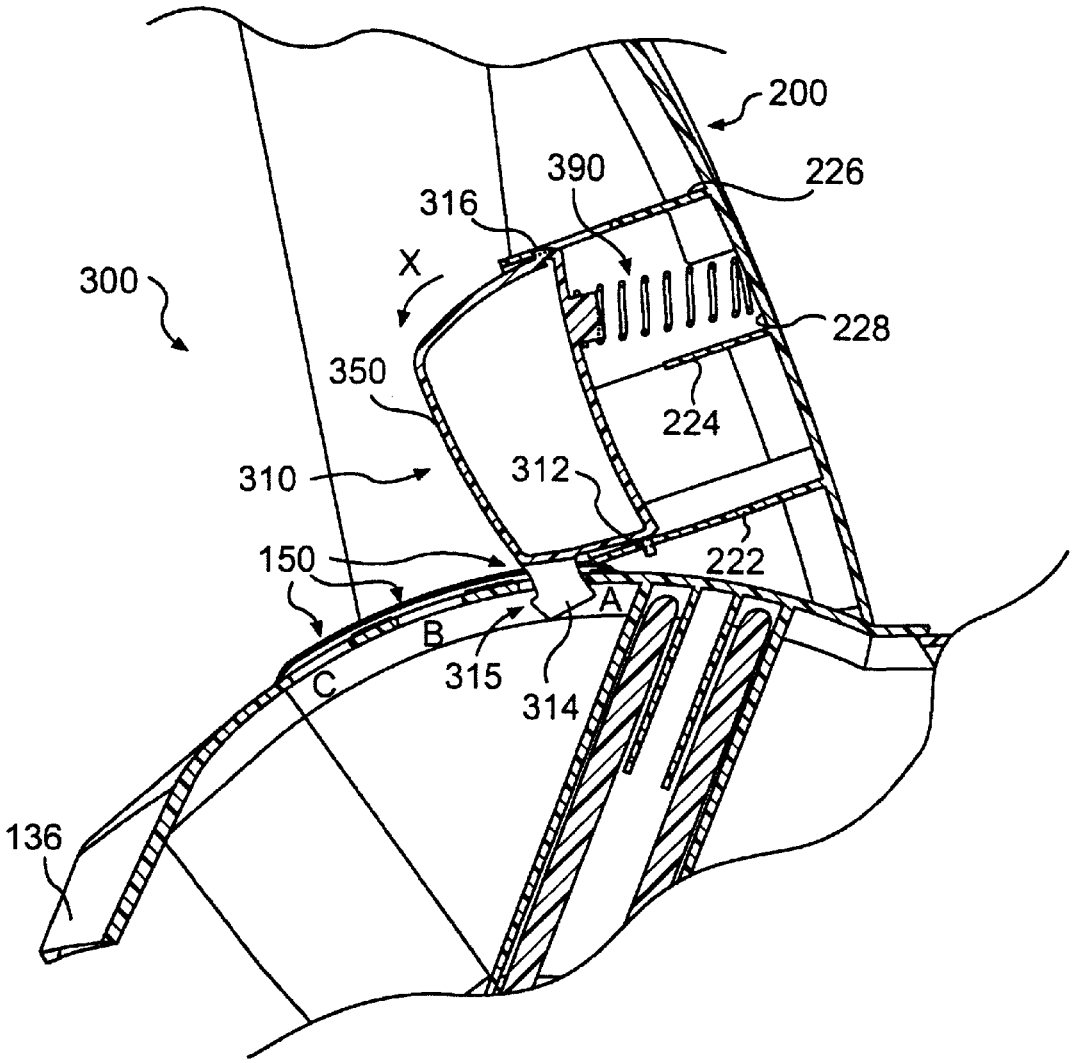
FIG. 5 is a partial cross sectional side view of the recline mechanism shown in FIGS. 1–4.

Each recline mechanism 300 comprises an engagement lever 310. The engagement levers 310 are mounted to the right and left sides of the seat back 200, as shown in FIG. 2. The engagement levers 310 each include teeth 314. The teeth 314 on the engagement levers 310 may engage respective openings 150 on the back rest support portions 134 of seat member 100 to lock the back rest 200 at a selected recline angle relative to the seat member 100. The engagement levers 310 are mounted to a back side of the back rest 200 between side panels of the back rest section 210 and fenders 220, as seen in FIGS. 3–5. The engagement levers 310 are mounted for movement between an engaged state (FIG. 6A) and a disengaged state (FIG. 6B). Spring elements 390 may bias the engagement levers 310 to the engaged state.

The assembly of an engagement lever 310 to the back rest 200 is shown in greater detail in FIG. 3. The engagement lever 310 may comprise an upper portion 320 and a lower portion 330. The lower portion 330 of the engagement lever 310 has a pair of teeth 314. The lower portion 330 also has a pivot member, or pivot tongue, 312. The upper portion 320 of the engagement lever 310 has a guide nub 316 and a spring retention post 318. The engagement lever 310 also has a gripping surface 350 that may be configured with notches or contours for fingers or palms. The engagement lever 310 may be shaped to have rounded, smooth surfaces.

As mentioned above, the engagement lever 310 is connected to the back rest 200 between a fender 220 and a side panel of the back rest section 210. The fender 220 is shown partially cut away in FIG. 3. The back rest 200 is provided with a plurality of ribs 222, 224, and 226 disposed between the back rest section 210 and the fender 220. Guide rib 226 is provided with a guide slot 236 to receive the guide nub 316 of the engagement lever 310. Spring retention rib 224 is provided below the guide rib 226. Pivot rib 222 is provided with a pivot slot 232 to receive the pivot tongue 312. Spring element 390 may be a spring that extends between the spring receiving post 318 of the lever 310 and spring bearing surface 228 of the back rest 200, as shown in FIG. 5. The spring 390 provides a biasing force about pivot 312 in the direction of arrow X of FIG. 5 to bias the lever in an engaged state, in which teeth 314 engage appropriate openings 150. It will be understood by those skilled in the art that the spring 390 may be placed in any number of locations so as to exert a force to bias the engagement lever 310. In addition, the spring 390 may be integrally appended to either the back rest 200 or the engagement lever 310.

FIG. 4 illustrates how the engagement lever 310 interacts with openings 150 in the back rest support portion 134 to operate as a recline mechanism 300 of the child high chair embodiment shown in FIG. 1. In FIG. 4, the fender 220 is shown partially cut away in order to more fully illustrate the manner in which the engagement lever 310 engages with the back rest support portion 134. As can be seen, guide nub 314 is positioned in guide slot 236; spring 390 is seated on spring receiving post 318; and pivot 312 is positioned in pivot slot 232 (not labeled). The pivot 312 serves as the fulcrum of the engagement lever 310. The engagement lever 310 is rotatable at least partially about the pivot 312.

FIG. 5 is a partial cross sectional side view of a recline mechanism 300, as shown in FIGS. 1–4. The teeth 314 of the engagement lever 310 are shown engaged in the first of a series of openings 150. In this embodiment, the teeth are positioned side-by-side, and the openings 150 are formed as sets of adjacent slots disposed at points A, B, and C along the arc of the back rest support portion 134. The openings 150 may be disposed equidistant from the pivot axis defined by hinge 160 (FIG. 2) so that the back rest 200 can pivot about the hinge 160. The teeth 314 engage tooth-receiving members or openings 150 on the back rest support portion 134 of the seat member 100 to lock the back rest 200 in place at a first angle corresponding to the set of slots disposed at point A, a second angle corresponding to the set of slots at point B, and so forth, to establish the recline angle of the back rest 200 relative to the seat section 110.

As previously mentioned, the back rest support portion 134 on either side of the child seat 10 is provided with a plurality of tooth-receiving members or openings 150, such as slots, notches, or holes. These openings 150 may be disposed serially along the arc of the back rest support portion 134 within the plane of motion of the engagement lever 310, as shown in FIG. 5. The various positions A, B, and C along the back rest support portion 134 of openings 150 define the various angles to which the back rest 100 may be adjusted. When the engagement teeth 314 are engaged in the openings 150, the back rest 100 is locked into position at the corresponding angle.

Figure 6A:
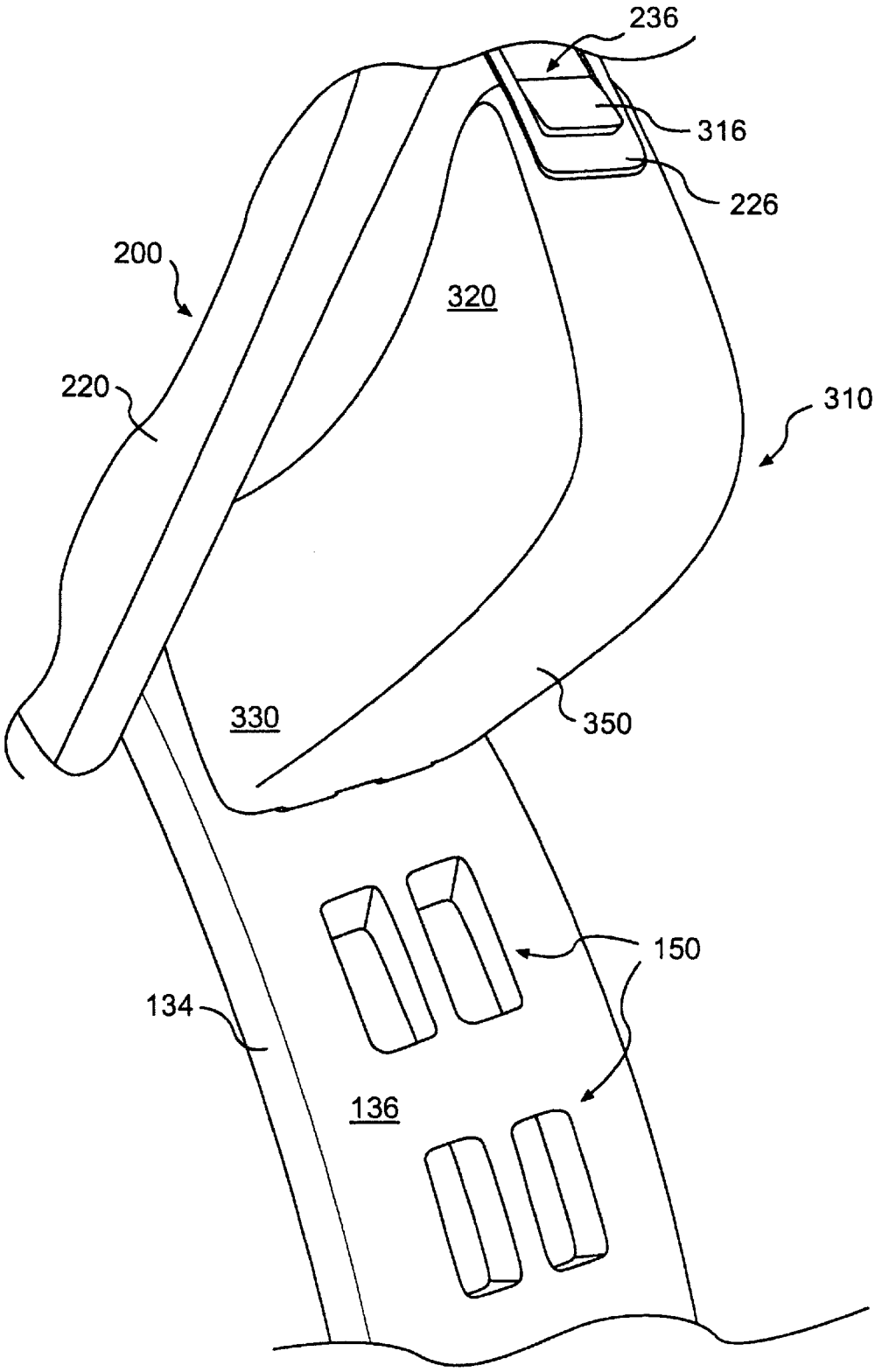
FIG. 6A is an enlarged, detail view of the recline mechanism of FIGS. 1–5 in an engaged state.
Figure 6B:
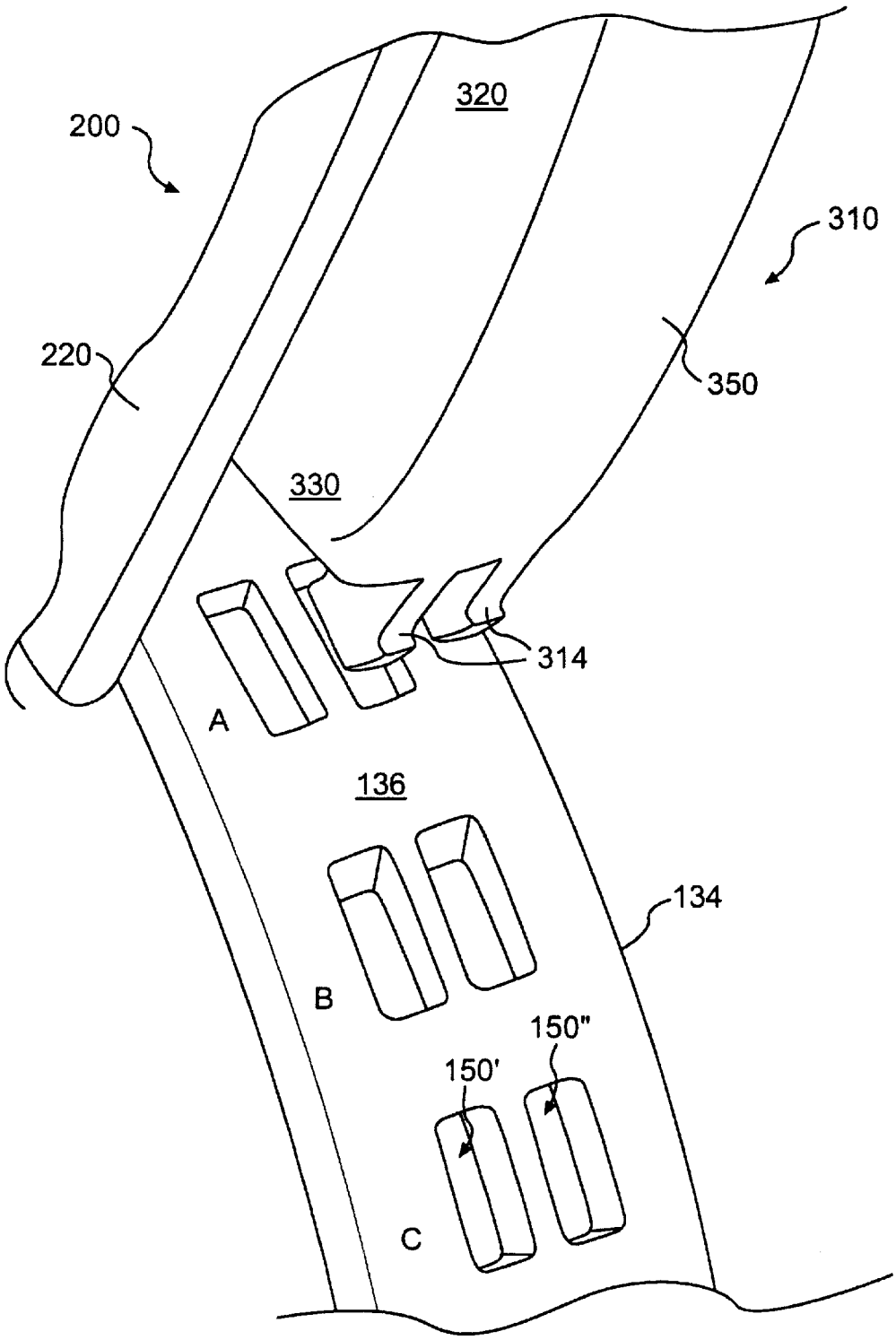
FIG. 6B is an enlarged, detail view of the recline mechanism of FIGS. 1–5 in a disengaged state.

The engagement lever 310 has at least two states, an engaged state and a disengaged state, shown in FIGS. 6A and 6B respectively. The lever 310 is biased to the engaged state of FIG. 6A by spring 390. In the engaged state, the teeth 314 of the engagement lever 310 are engaged in openings 150 on back rest support portion 134 of the seat member 100, as shown in FIGS. 4, 5, and 6A. In this state, the spring 390 exerts, by way of lever 310, a force on the wall defining the opening 150 to prevent the engagement teeth 314 from moving. Accordingly, the back rest 200 is prevented from pivoting and is locked in position. In addition, the guide nub 316 on upper portion 320 of engagement lever 310 may be biased to the end of guide slot 236 in guide rib 226.

The state of the engagement lever 310 may be changed by rotating the lever 310 about pivot 312 against the bias of the spring 390. Rotation of the lever 310 causes the spring 390 to extend or compress from its biased state, depending on the type of spring used and upon how the spring is disposed in relation to the lever. The spring 390 of the embodiment of FIGS. 1–6B is compressed upon movement of the lever 310 from its engaged state to its disengaged state. Other spring variations will be apparent to those skilled in the art. As the engagement lever 310 rotates about the pivot 312, the engagement teeth 314 disengage from the openings 150 and thus the lever 310 disengages from the back rest support portion 134.

FIG. 6B shows the lever 310 in the disengaged state. To disengage the lever 310, a user may place his palms against the front of the fenders 220 and wrap his fingers around the sides of the fenders 220 to contact the grip surface 350 of the levers 310. The user then can apply pressure on the levers 310 by squeezing the levers 310 toward the front face of the back rest 200. When pressure is exerted on the upper portion 320 or grip surface 350 of lever 310, the pivot 312 pivots in pivot slot 232 (hidden) to allow the lever 310 to rotate. As the lever 310 rotates, the teeth 314 disengage from openings 150. The back rest 200 then is free to pivot along the axis corresponding to the rear boundary 114 of the seat section 110.

FIG. 5 illustrates another aspect of the invention. The teeth 314 of the engagement lever 310 may include barbs 315. Barbs 315 assist in more securely locking the back rest 200 in position. In use, the slope of the barb 315 allows the tooth 314 to easily slide into slot 150. Once in the engaged state, the spring 390 biases the engagement lever 310 to cause the barb 315 to abut an interior surface of back rest support portion 134. Thus, when barbed tooth 314 engages tooth-receiving member 150, the barb 315 prevents the tooth 314 from being lifted out of slot 150 and locks the back rest relative to the seat member. To disengage the tooth 314 from the slot 150, the lever 310 may be disengaged by applying pressure to grip 350, which causes the lever 310 to pivot about pivot 312. Application of sufficient pressure on grip 350 allows the barb 315 to clear the slot 150.

It should be understood by those skilled in the art that the invention is not limited to an engagement lever having a pair of teeth that engage a pair of slots. Any appropriate number of teeth may be provided in a set of side-by-side teeth. Likewise, any number of slots may be provided per set of slots. In addition, the openings 150 of the invention are not limited to rectangular slots, and the teeth 314 of the invention are not limited to those having a rectangular bite pattern. The teeth and corresponding openings may be any suitable shape.

In the embodiment of FIGS. 1–6B, sets of adjacent slots 150 are employed instead of a single wide slot for each recline position A, B, and C. Use of adjacent slots, as compared to a single wide slot, allows a sufficient amount of material to be retained along the back rest support portion 134 of the seat member 100 and thus aids in preserving the structural integrity of the top surface 136 of seat sides 126, 128.

Figure 7:
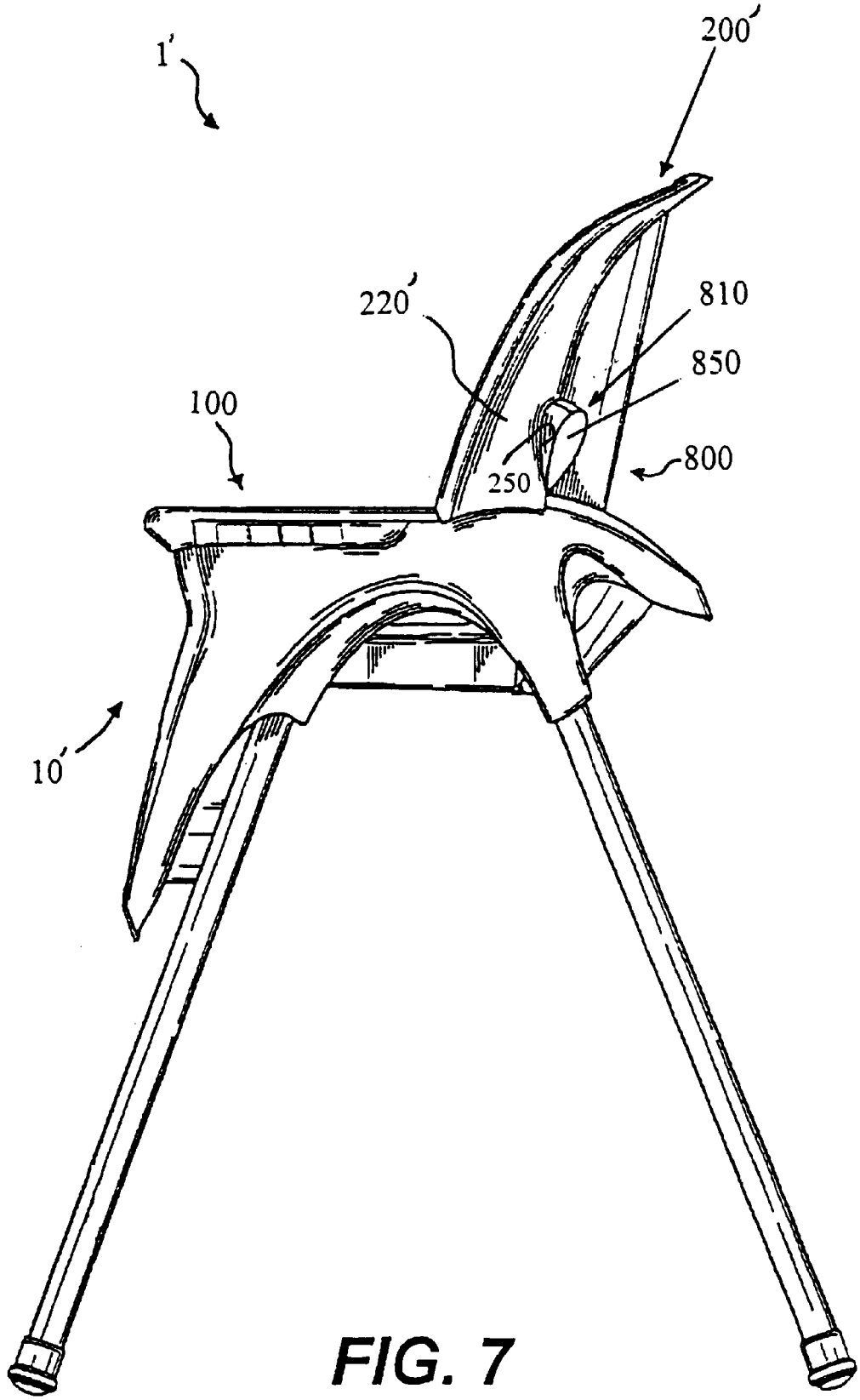
FIG. 7 is a side view of another embodiment of a reclining child seat shown as part of a high chair structure in accordance with the present invention.
Figure 8:
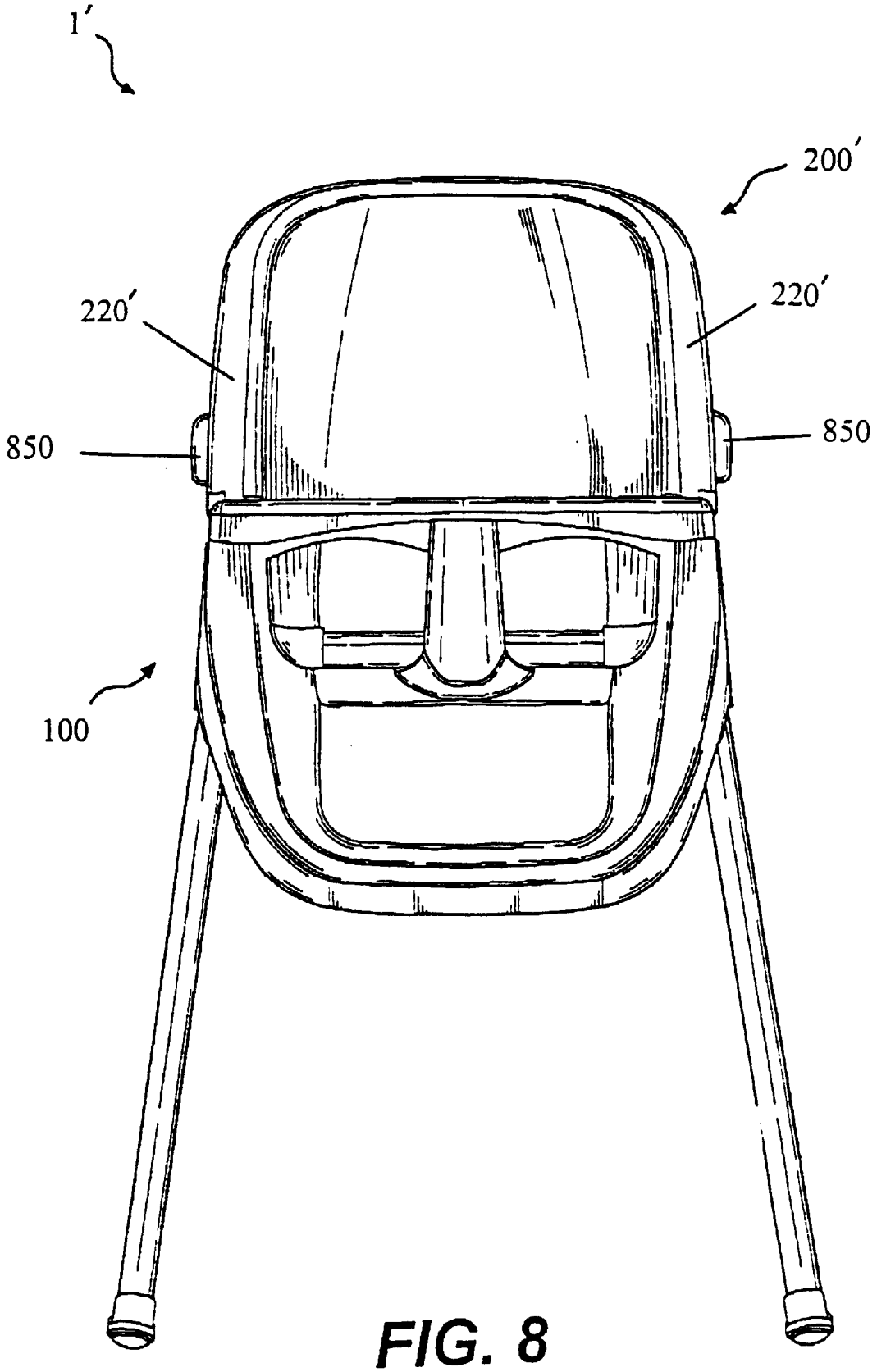
FIG. 8 is a front view of the invention shown in FIG. 7.

FIGS. 7–8 illustrate another embodiment of child seat 10 implemented in a high chair 1'. In this embodiment, a back rest 200' includes a side fender 220' having a recession 250. A recline mechanism 800 suitable for use with this seat 10' includes a lever 810 having an outwardly extending grip 850. The recession 250 allows the grip 850 to extend beyond fender 220' so that the grip 850 can be viewed from the front of the child seat, as shown in FIG. 8.

FIGS. 9–14 illustrate another embodiment of a reclining child seat in accordance with the invention. The reclining child seat of this embodiment is particularly suited for use in a child swing (not shown).

Figure 9:
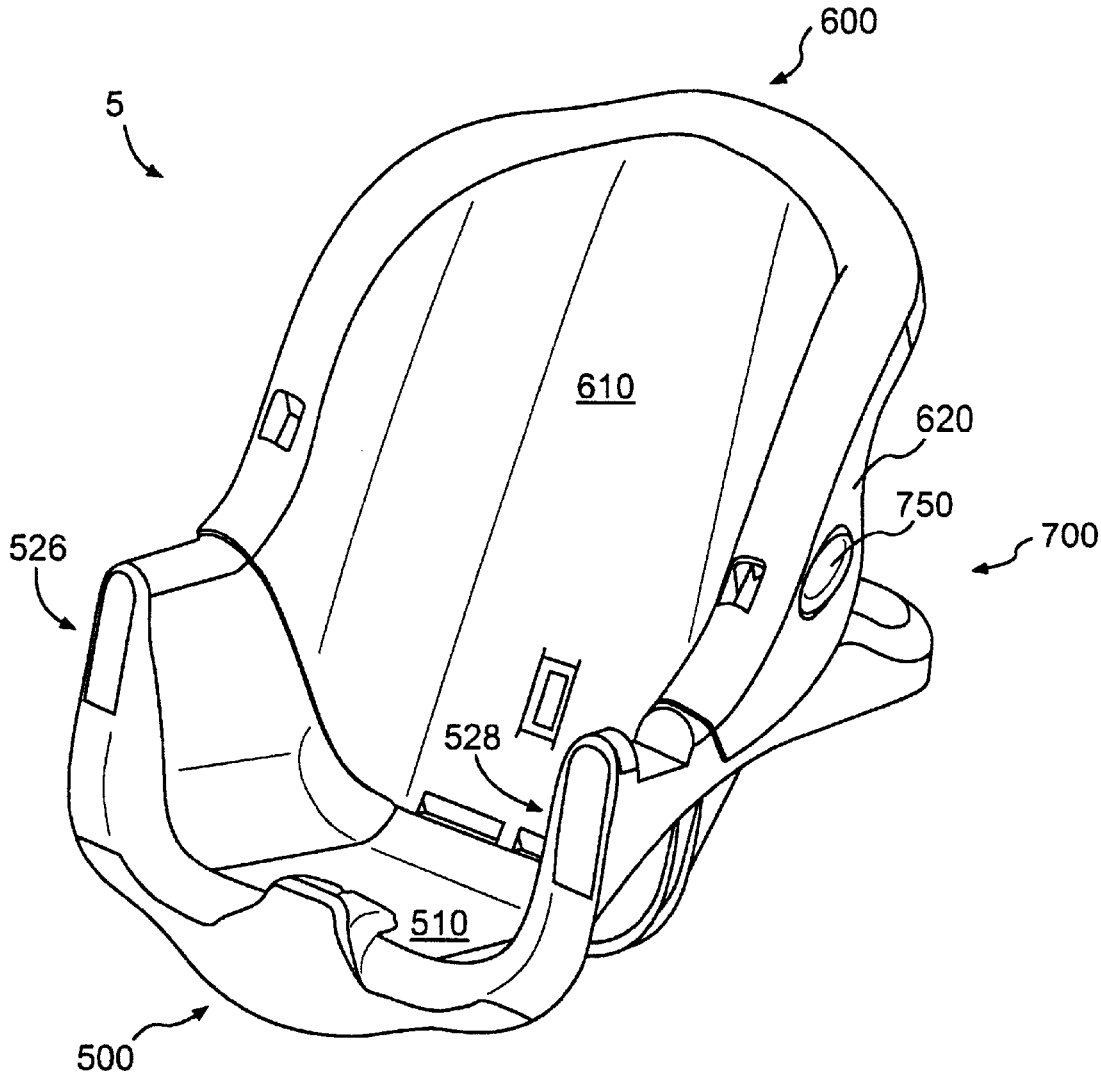
FIG. 9 is a front perspective view of yet another embodiment of a reclining child seat suitable, for example, for use in a child swing, in accordance with the present invention.
Figure 10:
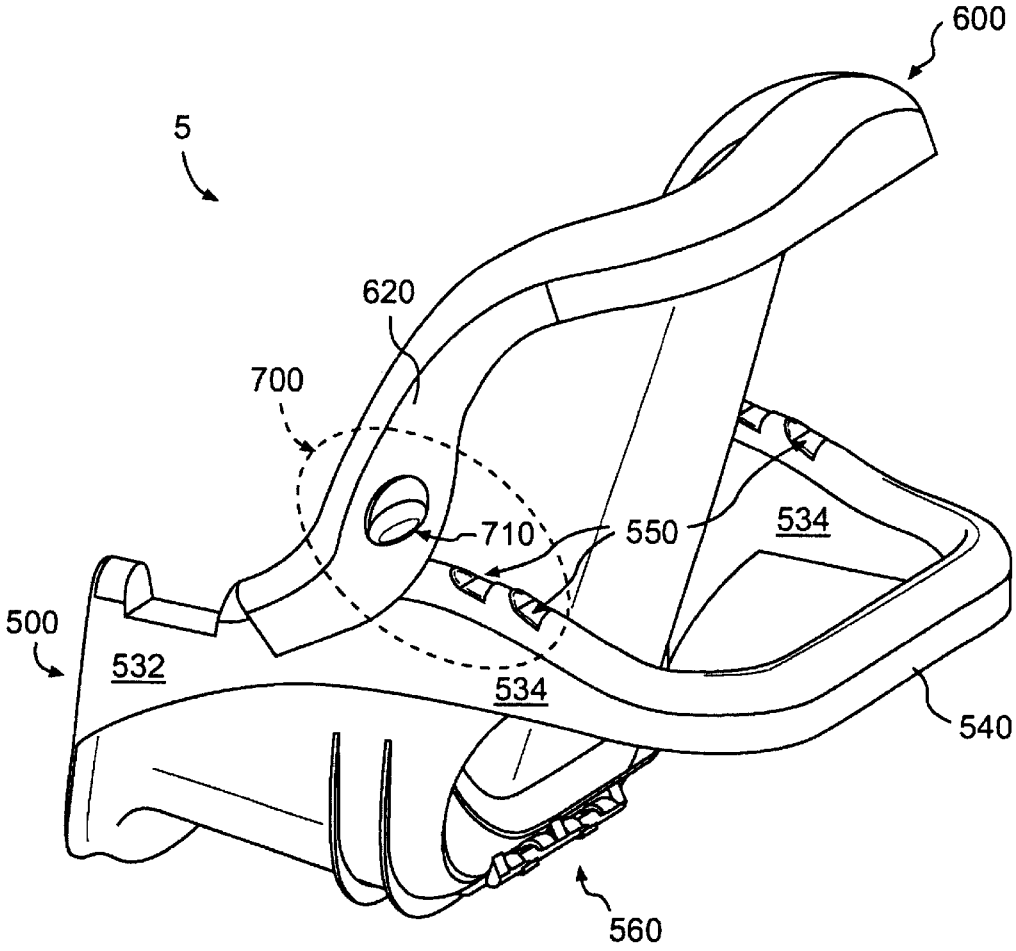
FIG. 10 is a rear perspective view of the reclining child seat of FIG. 9.

As shown in FIG. 9, the reclining child seat 5 includes a seat member 500, an adjustable back rest 600, and a recline mechanism on either side of the seat 5, generally indicated 700 in FIG. 10. Each recline mechanism 700 can include an engagement lever 710 and tooth-receiving members 550. The back rest 600 can be adjusted via the recline mechanism 700 to a plurality of angles with respect to the seat surface in a manner similar to that illustrated in FIG. 1.

Figure 11:
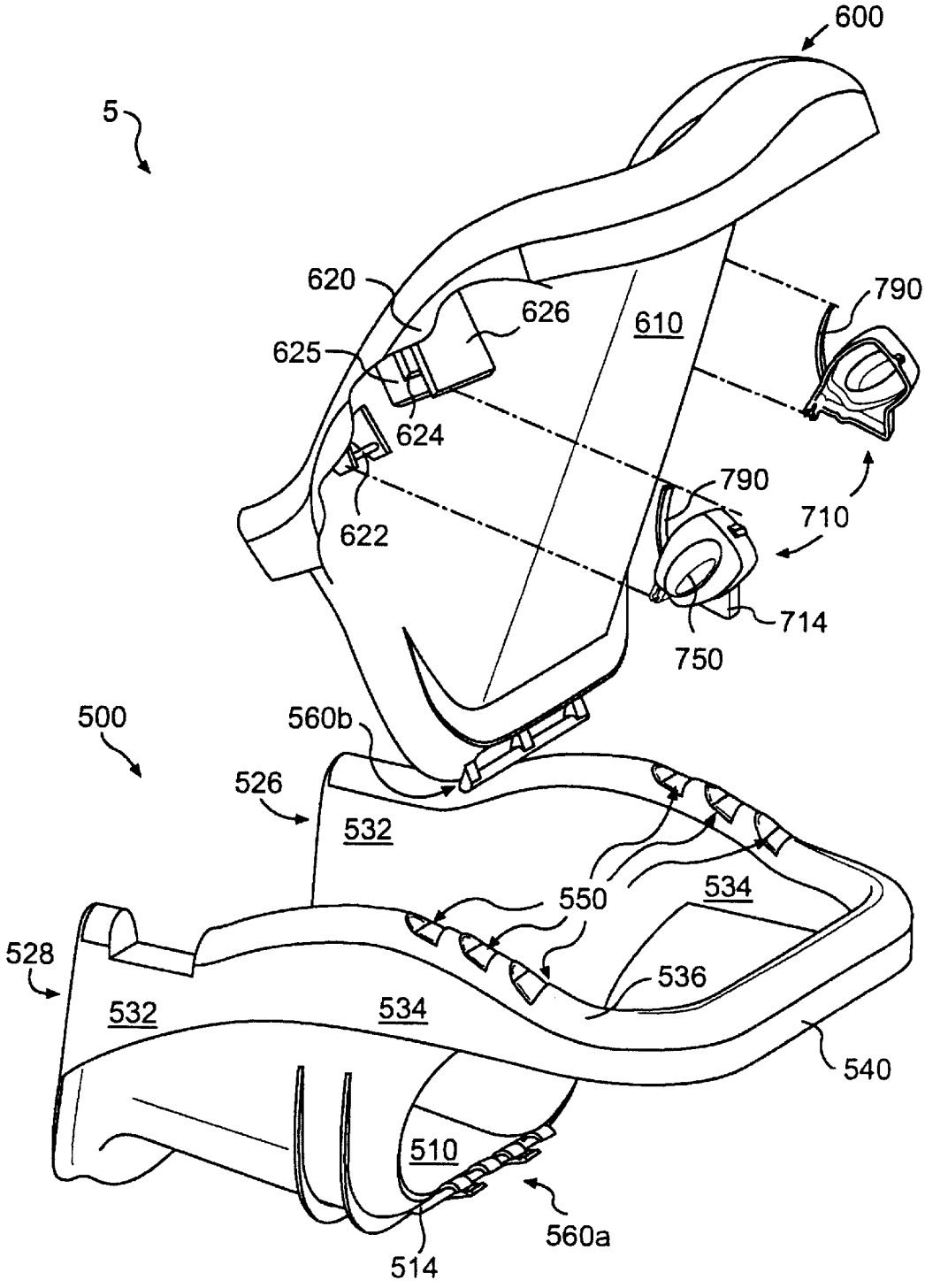
FIG. 11 is an exploded view of the reclining child seat of FIG. 9.

An exploded view of reclining child seat 5 is shown in FIG. 11. The adjustable back rest 600 is pivotally connected or mounted to seat 500. The seat member 500 includes seat section 510, and the back rest 600 includes back rest section 610. The back rest section 610 intersects an axis defined by or parallel to the rear boundary 514 of seat section 510.

The back rest 600 is connected to the seat member 500 via a hinge assembly 560*a*, 560*b* disposed along the rear boundary 514 of the seat section 510. This hinge assembly 560*a*, 560*b* allows the back rest 600 to pivot relative to the seat member 500 to adjust the angle between the back rest section 610 and the seat section 510. Other pivot connections may also be employed in seat 5, such as those discussed above in connection with the embodiment of FIGS. 1–6B.

Figure 12:
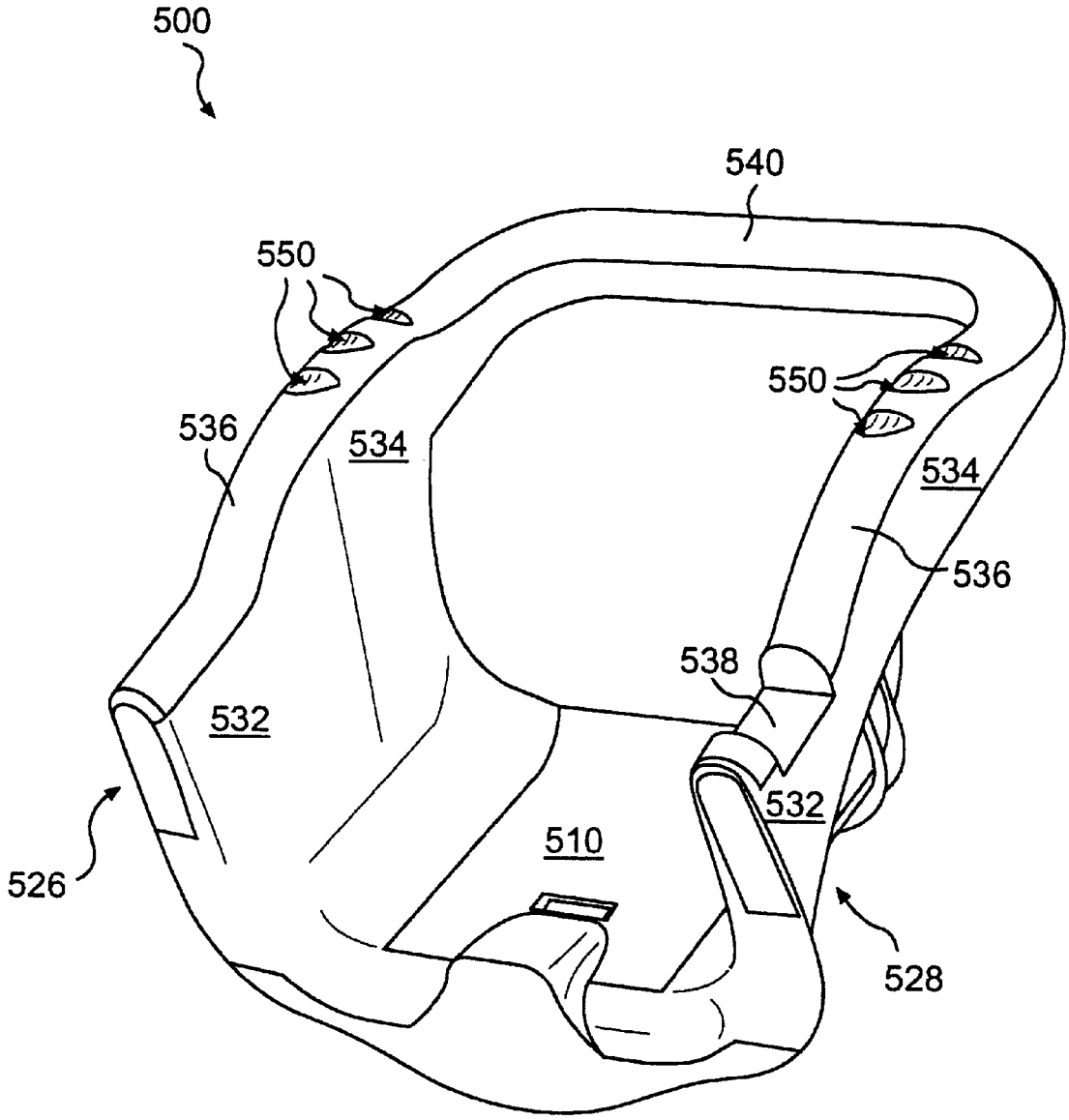
FIG. 12 is a top perspective view of a seat member of the reclining child seat of FIG. 9.

As shown in FIG. 12, the seat member 500 includes left and right seat sides 526 and 528, respectively, each having an arm support portion 532 and a back rest support portion 534. The earlier discussion relating to the configuration of arm and back rest support portions 132, 134 also applies to arm and back rest support portions 532, 534. The arm support portions 532 each can include fixtures 538 adapted to receive a child tray (not shown) for foodstuffs and child toys. In addition, like the embodiment of FIGS. 1–6B, the back rest support portions 534 may be connected to each other by a rear support 540.

The upper exterior surface 536 of each back rest support portion 534 includes spaced tooth-receiving members, or tooth-receiving openings, 550, such as notches, slots, apertures, depressions, or holes. The openings 550 are adapted to receive an engagement tooth 314 of an engagement lever 710, as will be described below.

As shown in FIG. 11, an engagement lever 710 has a single tooth 714. The tooth 714 of lever 710 is configured to interact with notches 550 on the back rest support portion 534 of seat member 500. The engagement levers 710 are mounted to a back side of the back rest 600 between side panels of the back rest section 610 and fenders 220 (partially cut away in FIG. 11). The engagement levers 710 are mounted for movement between an engaged state (FIG. 15A) and a disengaged state (FIG. 15B). A spring element 790 biases each engagement lever 710 to the engaged state. Spring element 790 may be a spring arm, as shown in FIG. 11.

Figure 13:
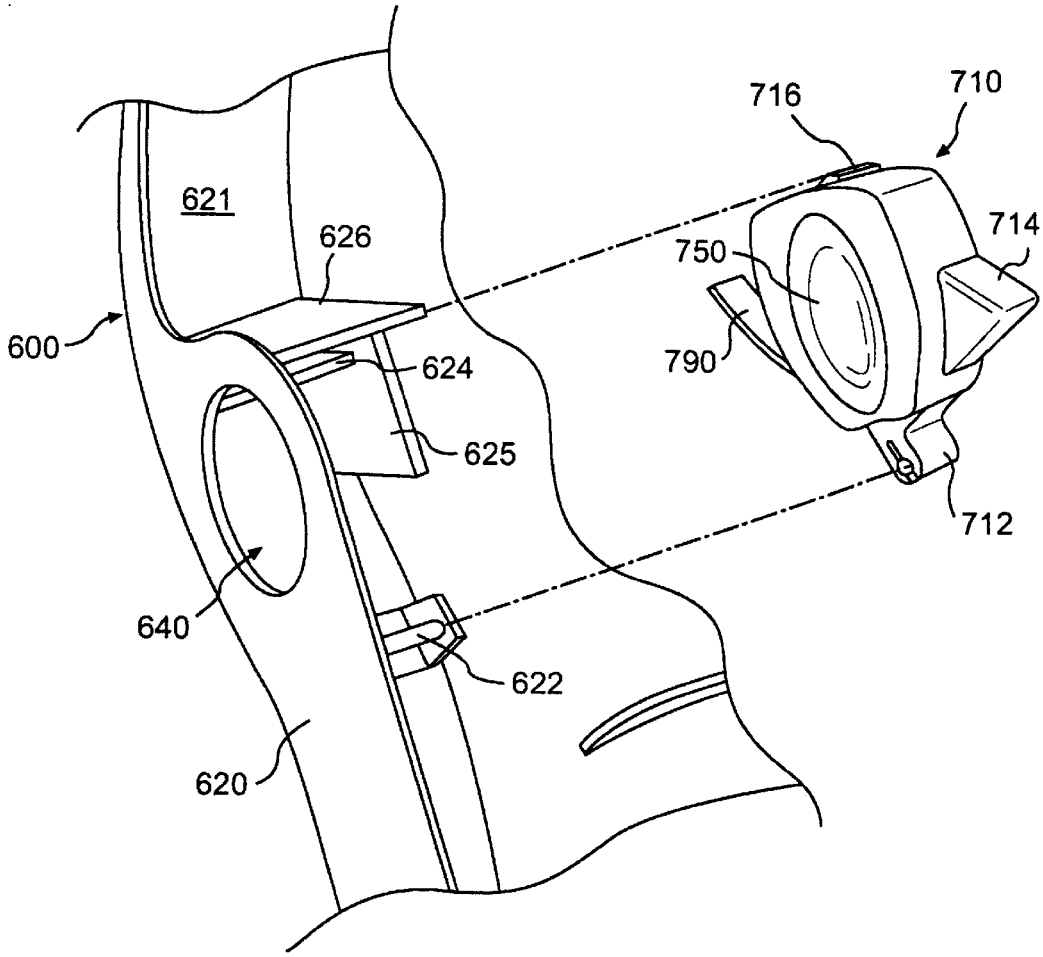
FIG. 13 is an exploded view of a portion of the recline mechanism of the child seat of FIG. 9.

The assembly of the single-toothed engagement lever 710 is shown in greater detail in FIG. 13. The engagement lever 710 includes tooth 714, a pivot mouth 712, a spring arm 790, a guide nub 716, and a grip 750. The fender 620 may have a window 640 disposed therein to provide access to grip 750, as shown in FIG. 13. In one embodiment, shown in FIG. 13, window 640 is elliptical or circular, and grip 750 is formed of elliptical or circular contours. Alternatively, the engagement lever 710 can be formed without grip 750, and the fender formed without a window, so that, when the lever is mounted to the back rest 600, it is substantially concealed by the fender 620 and not visible from the front of the child seat 5.

As seen in FIG. 13, the back rest 600 is provided with a pair of ribs 624, 626 disposed between the side panel of the back rest section 610 and the fender 620. Back rest 600 may be further provided with a wall 625. The wall 625 guides the motion of lever 710. Rib 626 may comprise a guide rib to retain the guide nub 716 of engagement lever 710 in a compression fit. A stop rib 624 is provided below guide rib 626 to limit forward movement of the engagement lever 710. The back rest also includes a pivot axle 622 that extends between the side panel of the rear surface section 610 and the fender 620. The pivot mouth 712 of the lever 710 can bite the pivot axle 622. When the lever 710 is mounted to the seat back 600, the spring arm 790 compresses against wall or spring arm bearing area 621 of the seat back 620 to provide a biasing force to lever 710 about pivot 622.

Figure 14:
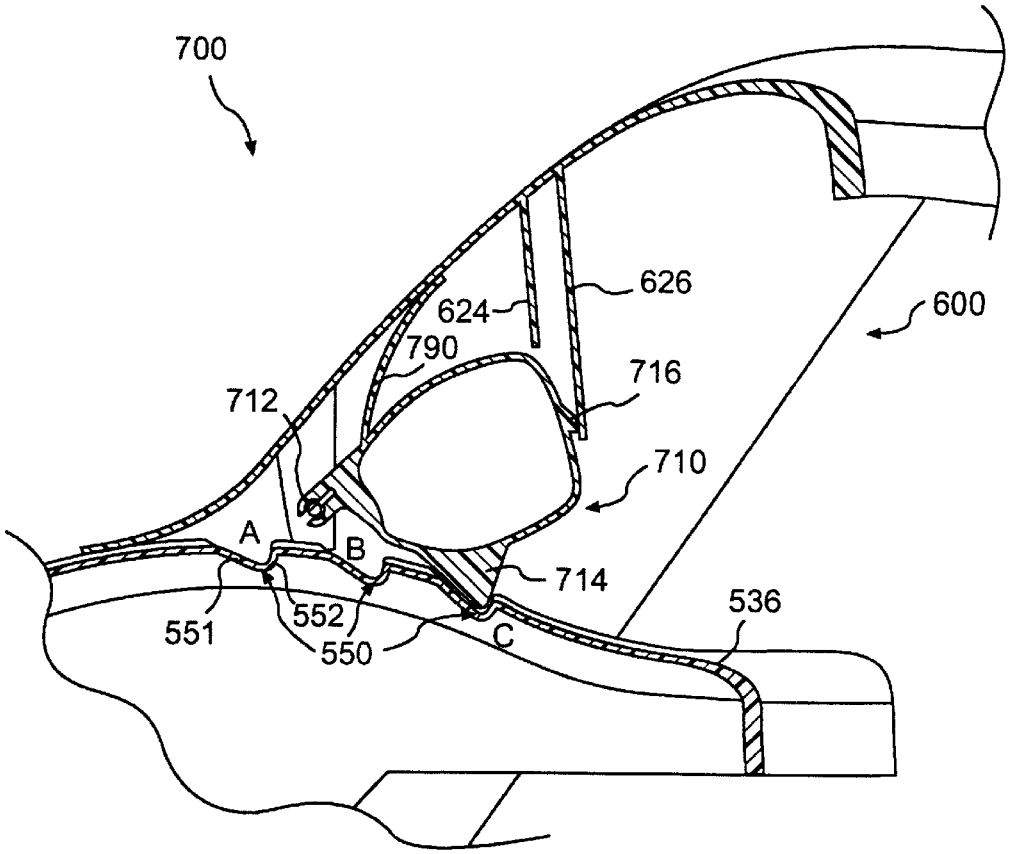
FIG. 14 is a partial cross sectional side view of the recline mechanism shown in FIGS. 9–13.

FIG. 14 shows a cross sectional view of the recline mechanism 700. The tooth 714 of the engagement lever 710 is shown engaged in the last of a series of notches 550. In this embodiment, the notches 550 may be disposed equidistant from the pivot axis defined by hinge 560 (FIG. 10). Notches 550 are disposed at each point A, B, C along an arc of the back rest support portion 534. The tooth 714 can be disengaged from notches 550 as described in connection with FIGS. 15A and 15B below. As can be appreciated from FIG. 14, once lever 710 is disengaged, the back rest 600 can be adjusted to a plurality of recline angles represented by the location of the notches 550 at points A, B, and C. Once at the desired angle, the lever 710 then can engage the appropriate notch 550 corresponding to that angle. The tooth 714 engages tooth-receiving member or notch 550 on the back rest support portion 534 of the seat member 500 to position the back rest 600 in place at a first angle corresponding to the notch disposed at point A, a second angle corresponding to the notch at point B, and so forth, to establish the recline angle of the back rest 600 relative to the seat section 510.

Figure 15A:
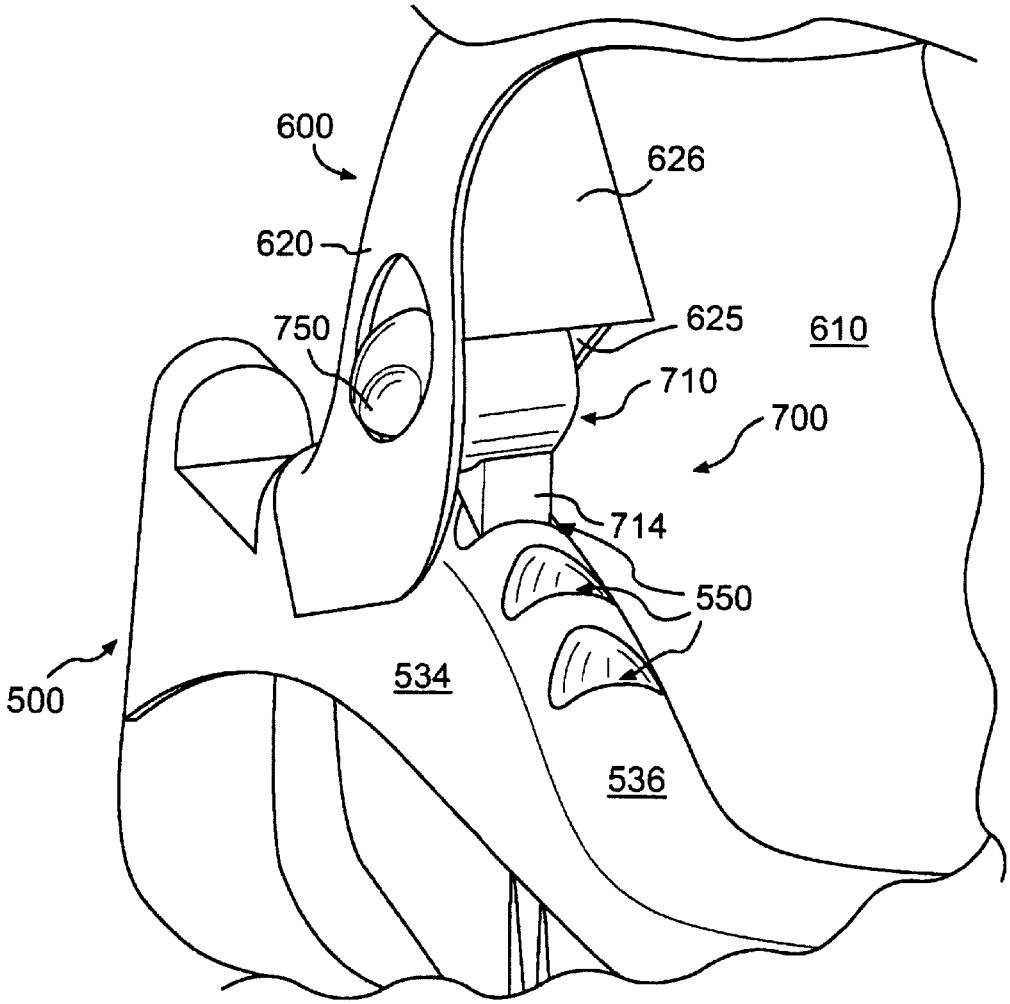
FIG. 15A is an enlarged, detail view of the recline mechanism of FIGS. 9–14 in an engaged state.
Figure 15B:
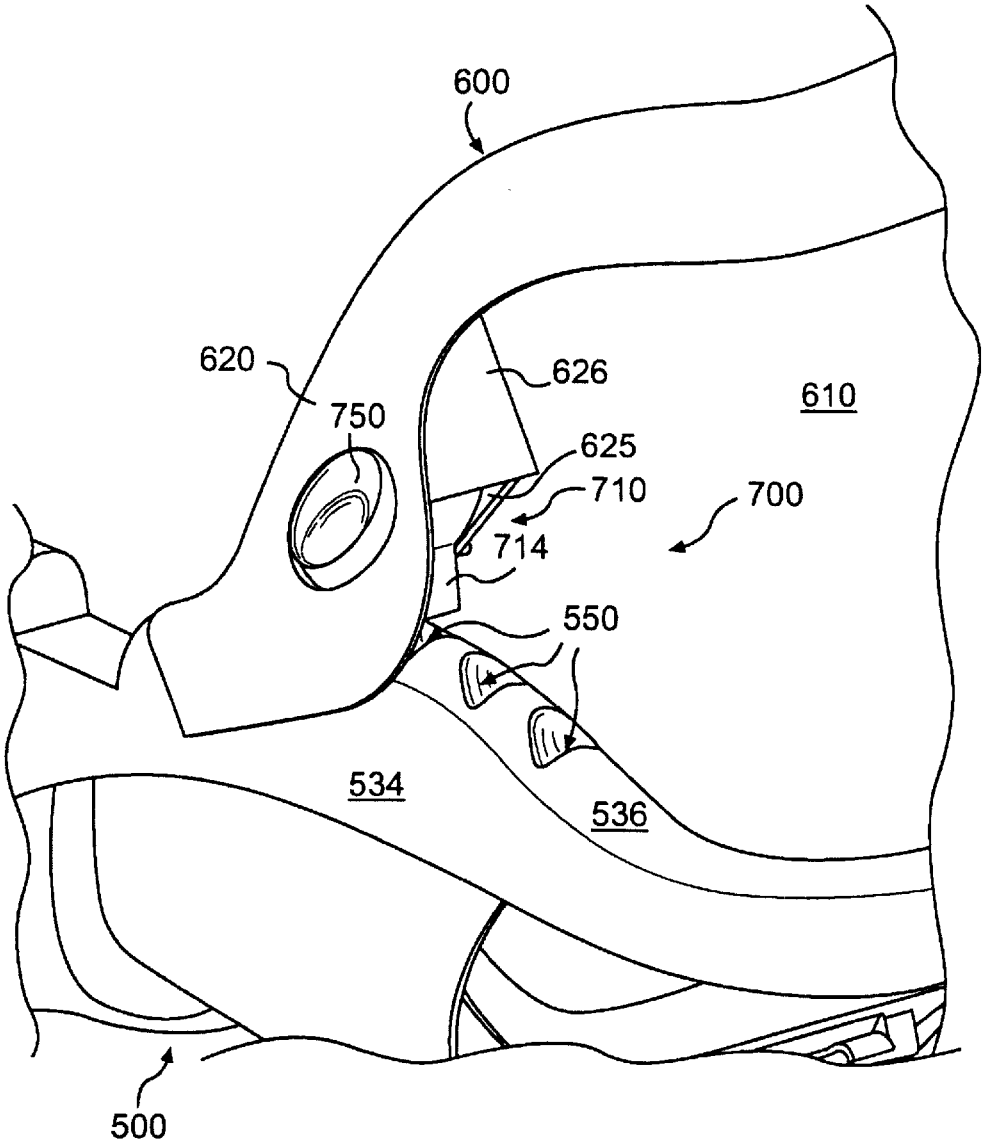
FIG. 15B is an enlarged, detail view of the recline mechanism of FIGS. 9–14 in a disengaged state.

A recline mechanism 700 of the child swing chair 5 is shown in greater detail in FIGS. 15A and 15B. In FIG. 15A, the recline mechanism 700 is shown with engagement lever 710 in its engaged state. The engagement lever 710 and grip 750 are biased away from the back rest 610 by the spring arm 790. Tooth 714 interacts with a notch 550 in back rest support portion 534 to prevent the rearward pivotal motion of the back rest 600 in position relative to the seat member 500.

FIG. 15B shows engagement lever 710 in the disengaged state. When a user exerts pressure on the grip 750 of lever 710, the lever 710 pivots about pivot axle 622 (hidden). As lever 710 pivots, the tooth 714 disengages from the notch 550. Once the lever 710 is disengaged, the back rest 600 can pivot about hinge 560 (FIG. 10).

The recline mechanisms of the present invention operates similarly in the various embodiments of the invention. Operation of a recline mechanism of child seat 5 of FIGS. 9–15B now will be described by way of example. A user facing the front of child seat 5 applies pressure to grip 750, pulling grip 750 toward the front of the child seat. This causes the tooth 714 of the engagement lever 710 to disengage from notch 550 in the back rest support portion 534 of seat member 500. The user then may adjust back rest 600 to a desired angle. Since the notches are located on an exterior surface 536 of the back rest support portion 534, the user can visually gauge where to position the back rest 600 by the location of the notches 550 (FIG. 15B). When the tooth 714 of the engagement lever 710 is aligned with a notch 550 corresponding to the desired recline angle, the user releases the pressure on grip 750, and the tooth 714 engages the notch 550 to position the back rest 600 in place. The back rest 600 may be inclined or reclined as appropriate using this method.

In another aspect of the invention, the rear support 140, 540 of the described embodiments may further serve as a recline block. For example, when the engagement lever 310, 710 of the child seat is in the disengaged state, the back rest 200, 600 is free to pivot about hinge 160, 560. It may be undesirable to allow the back rest 200, 600 to pivot beyond a certain angle. The rear support 140, 540 prevents the back rest 200, 600 from pivoting beyond this angle when lever 310, 710 is disengaged. A user also may deliberately recline the back rest 200, 600 fully, allowing the back rest 200, 600 to rest on rear support 140, 540. When the back rest 200, 600 is fully reclined to rest on rear support 140, 540, teeth 314, 714 of engagement lever 310, 710 may not be engaged in any openings or notches 150, 550.

FIG. 14 illustrates another novel aspect of the invention. Although a user must apply pressure to grip 750 to disengage the tooth 714 from the notch 550 to recline the back rest 600, the back rest 600 may be inclined without applying pressure to grip 750. The notch 550 in back rest support portion 534 has a forward slope 551 and rear face 552. In its engaged state, the tooth 714 abuts the rear face 552 to prevent the back rest 600 from further recline. However, when a user facing the front of child seat 5 pulls the back rest 600 forward, the slope 551 guides the tooth 714 out of the notch 550, and the back rest 600 can be inclined in the direction of the motion.

Thus, the back rest of the invention may adapted to be inclined more rapidly than it is reclined. It may be useful, for example, to recline back rest slowly and carefully if a child has fallen asleep while sitting upright in the child seat. However, if a child in the reclined position has awoken, it may be advantageous to be able to incline the back rest rapidly, without having to grip the recline mechanism directly.

In the embodiments described above, a recline mechanism is provided on the left and right sides of back rest. However, it will be understood that, in alternative embodiments, the child seat may be provided with a single engagement lever on one side of the back rest. In addition, the embodiments described above illustrate engagement levers mounted to the rear surface of the back rest. However, the engagement levers also may be located on the front, side, or other appropriate portion of the back rest, as would occur to those skilled in the art.

When a reclining child seat is provided with a pair of recline mechanisms, tooth-receiving openings are spaced identically on each side of seat member. To adjust the angle of a reclining seat having a pair of recline mechanisms, a user facing the front of child seat may disengage the levers by applying pressure to both levers simultaneously. The user may then adjust back rest to the proper angle. The user may be able to visually gauge the proper recline angle by examining exposed openings in the back rest support portion. When the teeth of the engagement levers are aligned with the openings corresponding to the desired recline angle, the user releases the pressure on the grips and the teeth engage the openings to position the back rest in place.

The width and spacing of openings, notches, or slots may be designed such that both levers need not be precisely aligned simultaneously. In addition, the recline mechanism may be designed such that the slope of the barb 316 (FIG.

4) or the slope 551 of the notch 550 (FIG. 14) guide the teeth into the engaged state when the teeth are only approximately aligned with the openings, slots, or notches.

While embodiments described above relate to use of a reclining child seat in the context of a child high chair and a child swing, it will be understood that the reclining child seat of the present invention may be adapted for use in a child restraint seat, an infant tote, a bassinet, or any other application where it may be desirable to have the ability to position the body of a child in either an upright or reclined posture. In addition, while the embodiments described above are directed to seats and chairs for infants and children, the invention is not so limited. As will occur to those skilled in the art, the recline mechanisms of the present invention may be useful in reclining chairs for adults or in other applications in which it may be desirable to have the ability to adjust the angle between two seat parts.

It should also be understood that the invention is not limited to the geometric configurations of the seat member and the back rest shown in the figures. Both the seat member and the back rest may be contoured to satisfy aesthetic or ergonomic requirements.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A chair comprising:

a seat member including a first back rest support portion and a second back rest support portion, the back rest support portions each having a tooth-receiving member at an upper exterior surface thereof;

a back rest pivotally connected to the seat member; and a first recline mechanism and a second recline mechanism, the recline mechanisms being individually operable, the recline mechanisms each including a lever mounted to the back rest, the lever having a tooth for receipt in the tooth-receiving member, the lever being movable between an engaged state and a disengaged state, wherein the lever is biased to the engaged state by a spring element, wherein, when the lever is in the engaged state, the tooth engages the tooth-receiving member to prevent rearward pivotal motion of the back rest relative to the seat member, wherein, when the lever is in the disengaged state, the tooth is disengaged from the tooth-receiving member, and wherein, when the levers of the recline mechanisms are both in the disengaged state, the back rest is allowed to pivot relative to the seat member.

2. The chair of claim 1, wherein the tooth-receiving member comprises a slot formed at the upper exterior surface of the respective back rest support portion.

3. The chair of claim 1, wherein the tooth-receiving member is a first tooth-receiving member, wherein each back rest support portion further comprises a second tooth-receiving member, and wherein the levers position the back rest at a first angle relative to the seat member when the teeth of the levers engage the first tooth-receiving members and at a second angle relative to the seat member when the teeth of the levers engage the second tooth-receiving members.

4. The chair of claim 1, wherein each back rest support portion further comprises a plurality of tooth-receiving members formed at the upper surface thereof at locations corresponding to different recline angles of the back rest relative to the seat member.

5. The chair of claim 1, wherein the seat member is connected to the back rest via a hinge.

6. The chair of claim 1, wherein the back rest further comprises a side fender with a window disposed therein, and the lever further comprises a grip extending through the window.

7. The chair of claim 1, wherein the spring element is a spring mounted between the lever and the back rest.

8. The chair of claim 1, wherein the spring element is a spring arm mounted to one of the lever and the back rest.

9. The chair of claim 8, wherein the spring arm is mounted to the lever to extend toward the back rest.

10. The chair of claim 1, wherein the lever comprises an upper portion having guide nub, a lower portion having a pivot member, and a spring retention post; and wherein the back rest comprises a first rib having a guide reception slot, a second rib having a pivot reception slot, and a spring bearing area.

11. The chair of claim 1, wherein the spring element is a spring arm, and wherein the lever comprises an upper portion having guide nub and a lower portion having a pivot member; and wherein the back rest further comprises a guide rib, a spring arm bearing area, and a pivot axle.

12. The chair of claim 1, wherein the chair is one of a child swing and a child high chair.

13. A chair comprising:

a seat member having a first side and a second side, each side having a tooth-receiving member;

a back rest pivotally connected to the seat member; and a first recline mechanism and a second recline mechanism, the recline mechanisms each including a lever mounted to the back rest, the lever having a barbed tooth, the lever being movable between an engaged state and a disengaged state, wherein, when the lever is in the engaged state, the barbed tooth engages the tooth-receiving member to prevent rearward pivotal motion of the back rest relative to the seat member, wherein, when the lever is in the disengaged state, the barbed tooth is disengaged from the tooth-receiving member, and wherein, when the levers of the recline mechanisms are both in the disengaged state, the back rest is allowed to pivot relative to the seat member.

14. The chair of claim 13, wherein the tooth-receiving member comprises a slot formed at an upper exterior surface of the seat member.

15. The chair of claim 13, wherein the tooth-receiving member is a first tooth-receiving member, wherein each side of the seat member further comprises a second tooth-receiving member, and wherein the levers position the back rest at a first angle relative to the seat member when the barbed teeth of the levers engage the first tooth-receiving members and at a second angle relative to the seat member when the barbed teeth engage the second tooth-receiving members.

16. The chair of claim 13, wherein each side of the seat member further comprises a plurality of tooth-receiving members formed at locations corresponding to different recline angles of the back rest relative to the seat member.

17. The chair of claim 13, wherein the seat member is connected to the back rest via a hinge.

18. The chair of claim 13, wherein the back rest further comprises a side fender with a window disposed therein, and the lever further comprises a grip extending through the window.

19. The chair of claim 13, wherein the lever is biased to the engaged state by a spring element.

20. The chair of claim 19, wherein the spring element is a spring mounted between the lever and the back rest.

21. The chair of claim 20, wherein the lever comprises an upper portion having guide nub, a lower portion having a pivot member, and a spring retention post; and wherein the back rest comprises a first rib having a guide reception slot, a second rib having a pivot reception slot, and a spring bearing area.

22. The chair of claim 19, wherein the spring element is a spring arm, and wherein the lever comprises an upper portion having guide nub and a lower portion having a pivot member; and wherein the back rest further comprises a guide rib, a spring arm bearing area, and a pivot axle.

23. The chair of claim 13, wherein the chair is one of a child swing and a child high chair.

24. A chair comprising:

a seat member having a first side and a second side, each side having a set of tooth-receiving members;

a back rest pivotally connected to the seat member; and a first recline mechanism and a second recline mechanism, the recline mechanisms being individually operable, the recline mechanisms each including a lever mounted to the back rest, the lever having a set of teeth, the lever being movable between an engaged state and a disengaged state, wherein the lever is biased to the engaged state by a spring element, wherein, when the lever is in the engaged state, the set of teeth engages the set of tooth-receiving members to prevent rearward pivotal motion of the back rest relative to the seat member, wherein, when the lever is in the disengaged state, the set of teeth is disengaged from the set of tooth-receiving members, and wherein, when the levers of the recline mechanisms are both in the disengaged state, the back rest is allowed to pivot relative to the seat member.

25. The chair of claim 24, wherein the set of tooth-receiving members is a first set of tooth-receiving members, wherein each side of the seat member further comprises a second set of tooth-receiving members, and wherein the levers position the back rest at a first angle relative to the seat member when the sets of teeth of the levers engage the first sets of tooth-receiving members and at a second angle relative to the seat member when the sets of teeth engage the second sets of tooth-receiving members.

26. The chair of claim 25, wherein the first set of tooth-receiving members comprises a first pair of adjacent slots formed in the seat member, the second set of tooth-receiving members comprises a second pair of adjacent slots formed in the seat member spaced from the first pair of adjacent slots, and the set of teeth comprises a pair of teeth arranged to selectively engage the first and second pairs of adjacent slots.

27. The chair of claim 24, wherein each side of the seat member comprises a plurality of sets of tooth-receiving members at locations corresponding to different recline angles of the back rest relative to the seat member.

28. The chair of claim 24, wherein the chair is one of a child swing and a child high chair.

* * * * *